US005389017A

United States Patent [19]

Huzjak

[11] Patent Number: 5,389,017

[45] Date of Patent: Feb. 14, 1995

[54] FOLDING BOAT TRANSOM

[76] Inventor: George P. Huzjak, 1826 S. 71st St., West Allis, Wis. 53214

[21] Appl. No.: 97,249

[22] Filed: Jul. 26, 1993

[51] Int. Cl.[6] ..... B63H 5/12

[52] U.S. Cl. ..... 440/53; 248/642; 248/641; 440/900

[58] Field of Search ..... 248/640–643; 440/6, 53, 900, 62; 114/343, 364

[56] References Cited

U.S. PATENT DOCUMENTS

| | | | |
|---|---|---|---|
| 3,648,645 | 3/1972 | Ezell | 115/41 |
| 3,941,072 | 3/1976 | Caton et al. | 114/165 |
| 4,168,818 | 9/1979 | Ellis | 248/640 |
| 4,306,703 | 12/1981 | Finze | 440/900 |

FOREIGN PATENT DOCUMENTS

| | | |
|---|---|---|
| 0144298 | 6/1985 | European Pat. Off. . |
| 2005206 | 12/1969 | France . |

*Primary Examiner*—Edwin L. Swinehart
*Attorney, Agent, or Firm*—Wheeler & Kromholz

[57] ABSTRACT

A folding transom for a boat having a trolling motor. The folding transom having an "engaged position" and a "retracted position". The transom including a motor mounting bracket, a pair of parallel horizontal legs, having first and second ends, each leg being attachable to a boat at the first end, a pair of "L" shaped members, maintained in parallel relationship, each of which is rotatably attached at one end of the "L" shaped member to the second end of a horizontal leg by a thumb screw for locking the "L" shaped member into an engaged position and on the other end of the "L" shaped member to the motor mounting bracket.

5 Claims, 2 Drawing Sheets

FOLDING BOAT TRANSOM

BACKGROUND OF THE INVENTION

There are many devices for attaching a trolling motor to the transom of a boat along with a larger drive motor. However, most such systems are awkward to use because of interference between the two motors.

There are also schemes for attaching a trolling motor to the bow of a boat but none, of which I am aware, provide the simplicity and ease of use of my invention. The present invention could also be attached to the stem of a boat but would preferably be attached to the bow.

SUMMARY OF THE INVENTION

My invention comprises the following elements: A pair of parallel legs which attach to a boat on one end and are pivotably attached, by a lockable pivot means, to the first ends of a pair of "L" shaped members on the other end. In the preferred embodiment, these members have stop means cast as part of the members for maintaining a motor attached to the device in an "engaged" position. The second ends of the "L" shaped members are adjustably attached to a motor mounting bracket which may be a piece of 2×4 lumber about one foot long. Additionally, at least one of the "L" shaped members includes a safety stop means for preventing kickback of the motor when the motor is attached to the device in the "engaged" position.

DETAILED DESCRIPTION

Figure 1:
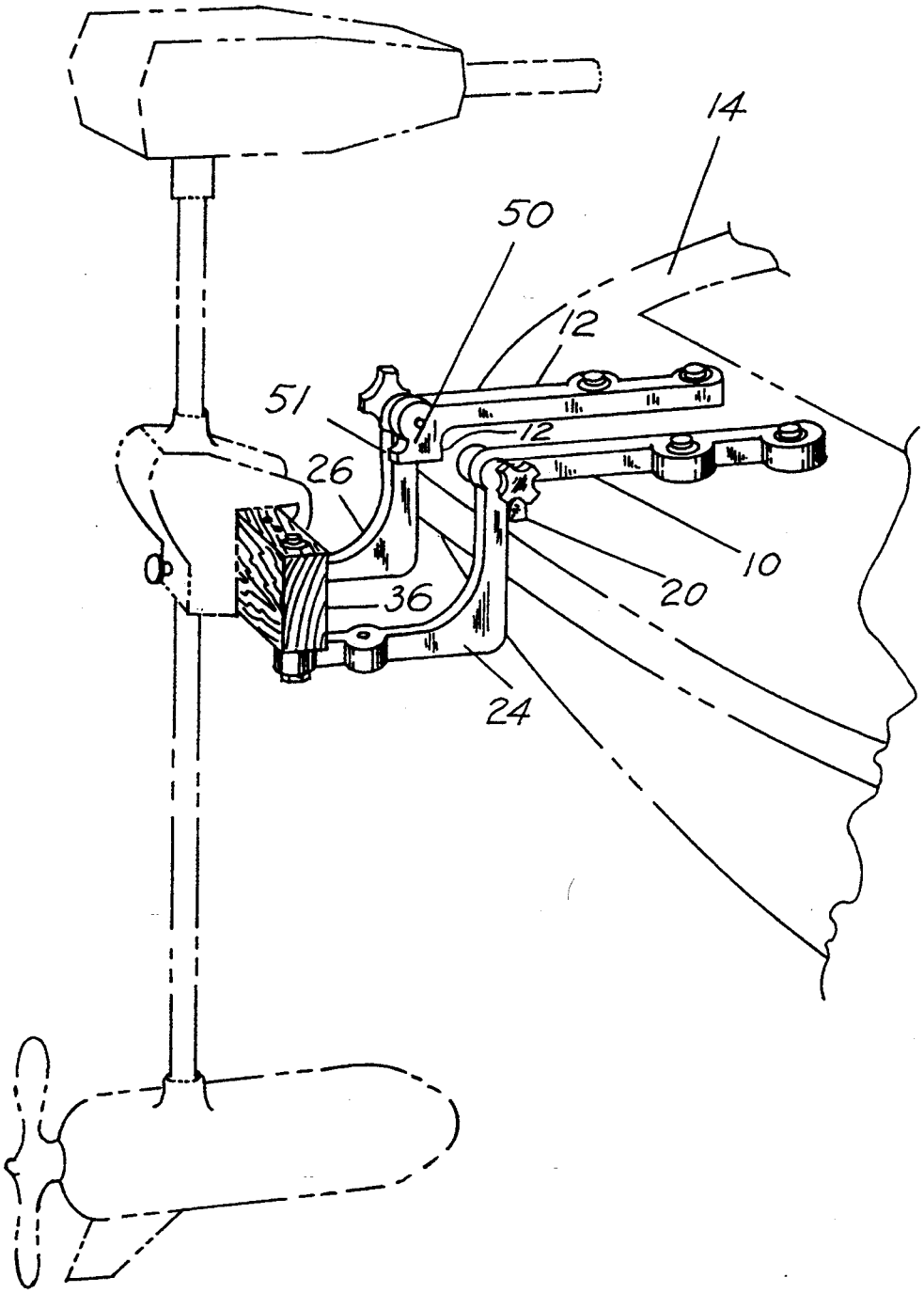
FIG. 1 is a perspective view of the present invention showing the invention attached to the bow of a boat with the trolling motor in place.
Figure 2:
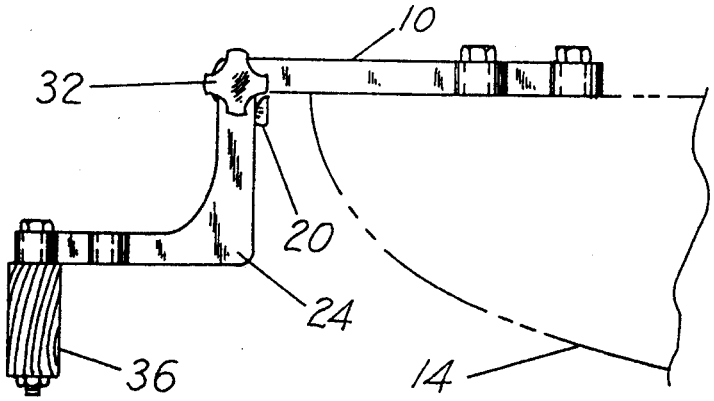
FIG. 2 is a side elevational view of the present invention.
Figure 3:
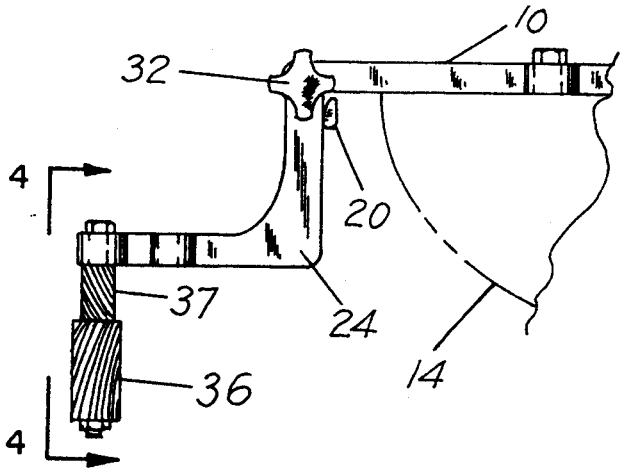
FIG. 3 is a side elevational view of the present invention showing added spacer blocks to drop the transom.

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

Referring to FIGS. 1–5, this device comprises a pair of parallel horizontal legs of rectangular cross-section numbered 10 and 12 each of which may be attached by any convenient means on a first end to the bow or stern of boat 14. The second ends of legs 10 and 12 have threaded holes 16 and 18 formed therein. In the preferred embodiment, stops 20 and 22 are cast as part of legs 10 and 12. However, stops 20 and 22 could be detachable from legs 10 and 12 if preferred. The device further comprises a pair of "L" shaped members, 24 and 26, of rectangular cross-section. Member 24 has hole 28 formed in one end of it and member 26 has hole 30 formed in one end of it. A thumb screw 32 rotatably attaches member 24 to leg 10 by passing through hole 28 and being threaded into hole 16. Thumb screw 34, in conjunction with holes 18 and 30, provides the rotatable attachment of "L" shaped member 26 to leg 12.

The other end of "L" shaped member 24 is bolted to motor mounting bracket 36 through one of a plurality of holes 38 in the right end of motor mounting bracket 36 and the other end of "L" shaped member 26 is bolted to motor mounting bracket 36 through one of a plurality of holes 40 in the left end of bracket 34. Although it could be made of other materials such as aluminum or plastic, motor mounting bracket 34 is made from a piece of wood in the preferred embodiment. In the model, the length of bracket 34 is 10 inches, the width is 1 ¾ inches and the depth is 2 ¾ inches.

This folding transom device is used by attaching the first ends of legs 10 and 12 to the bow or stem of a boat 14 a convenient distance apart and in parallel relationship. A trolling motor is attached to bracket 34 when the folding transom device of the present invention is attached to the boat 14. When not running, the motor may be rotated clockwise out of the water to a point where the motor is resting on the boat 14.

Thumb screws 32 and 34 are tightened to inhibit rotation after the motor has reached a "retracted position" up and out of the water. To place the motor in the "engaged position" for trolling, the motor is rotated into the water until the "L" shaped members engage stops 20 and 22. Thumb screws 30 and 34 are then tightened and locked in place by lock washers 35 shown in FIG. 5.

Figure 5:
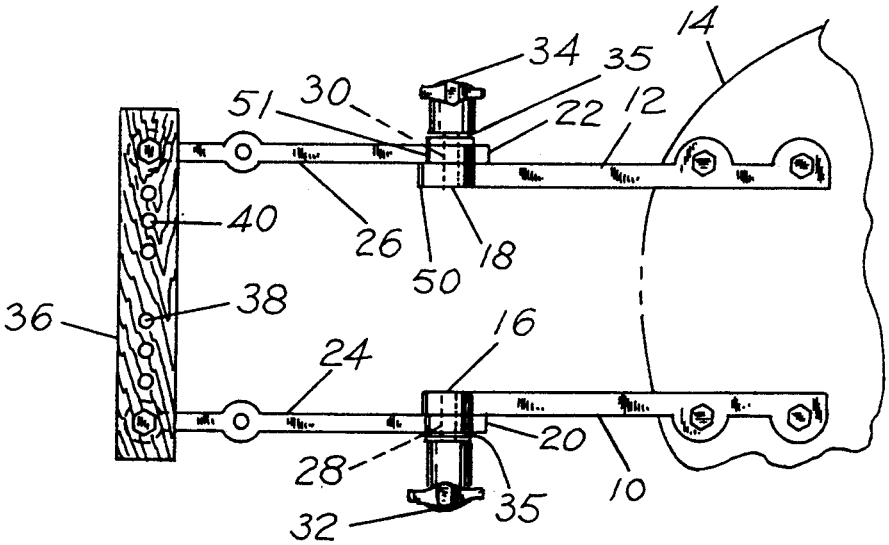
FIG. 5 is a top plan view of the present invention.

Additionally, referring to FIGS. 1 and 5, the present invention includes the improvement of a safety stop 50 having a flange 51 on at least one of the parallel members 10 or 12. When the thumb screw associated with the parallel member having the safety stop 50 and the "L" shaped member connected to the parallel member (in the present embodiment this may be seen to be "L" shaped member 26, parallel member 12, and thumb screw 34) is loose the flange 51 may be moved so as not to engage the "L" shaped member 12. This allows the "L" shaped members to be easily moved from their engaged to their retracted positions by swinging past the flange 51.

However, when the "L" shaped members are in the engaged position the flange 51 is engaged with the "L" shaped member 26 when the thumb screw 34 is tightened and locked in place by the locking washers 35. This prevents movement of the motor from the engaged position. Accordingly, the motor is now unable to inadvertently kick-up and cause injury to the operator. This improvement enhances the safety and efficiency of the present invention by ensuring safe operation of the trolling motor.

Figure 4:
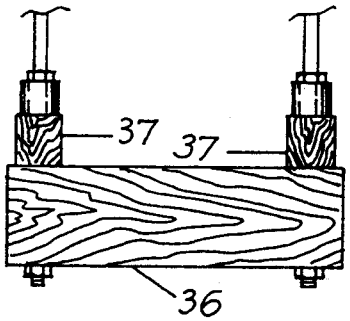
FIG. 4 is a view from line 4—4 of FIG. 3.

Further, the present invention may be modified by using spacer blocks 37, as shown in FIGS. 4 and 5, to raise or lower the trolling motor so that the position of the trolling motor is always optimum regardless of whether or not the boat 14 sits high or low in the water.

The above described embodiments of this invention are merely descriptive of its principles and are not to be limited. The scope of this invention instead shall be determined from the scope of the following claims, including their equivalents.

What is claimed is:

1. A folding transom having an "engaged position" and a "retracted position" which comprises:

a motor mounting bracket;

a pair of parallel horizontal legs, having first and second ends, each leg being attachable to a boat at the first end;

a pair of "L" shaped members, maintained in parallel relationship, each of which is rotatably attached at one end of the "L" shaped member to the second end of a horizontal leg by a fastener for fastening for locking the "L" shaped member into an engaged position and on the other end of the "L" shaped member to the motor mounting bracket.

2. The folding transom of claim 1 further including a stop means, for maintaining a motor in the "engaged position", located between at least one "L" shaped member and at least one horizontal leg.

3. The folding transom of claim 2 in which the stop means is a flange.

4. The folding transom of claim 3 in which the stop means is flange integral to at least one horizontal leg.

5. The folding transom of claim 1 further including at least one spacer block, for adjusting the position of a boat motor with respect to the boat, connected to the motor mounting bracket.

* * * * *

UNITED STATES PATENT AND TRADEMARK OFFICE

CERTIFICATE OF CORRECTION

PATENT NO. : 5,389,017
DATED : February 14, 1995
INVENTOR(S) : George P. Huzjak

It is certified that error appears in the above-indentified patent and that said Letters Patent is hereby corrected as shown below:

Column 1, line 13, delete "stem", insert --stern--

Column 2, line 15, delete "stem", insert --stern--

Signed and Sealed this

Twenty-third Day of May, 1995

*Attest:*

Bruce Lehman

BRUCE LEHMAN

*Attesting Officer*

*Commissioner of Patents and Trademarks*